US007509946B2

(12) United States Patent
Cooke et al.

(10) Patent No.: US 7,509,946 B2
(45) Date of Patent: Mar. 31, 2009

(54) PIEZOELECTRIC FUEL INJECTORS

(75) Inventors: Michael P. Cooke, Gillingham (GB); Adrian R. Tolliday, Chatham (GB)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 11/894,930

(22) Filed: Aug. 22, 2007

(65) Prior Publication Data

US 2008/0047529 A1 Feb. 28, 2008

(30) Foreign Application Priority Data

Aug. 23, 2006 (GB) ..... 0616713.4

(51) Int. Cl.
*F02M 37/04* (2006.01)
*F02M 37/08* (2006.01)

(52) U.S. Cl. ..... 123/498; 239/102.2

(58) Field of Classification Search ..... 123/498, 123/490, 478; 239/102.2, 102.1, 585.1, 585.5; 310/317, 323.06, 316.03
See application file for complete search history.

(56) References Cited

U.S. PATENT DOCUMENTS

| | | | | |
|---|---|---|---|---|
| 6,253,736 | B1 * | 7/2001 | Crofts et al. | 123/498 |
| 6,478,013 | B1 * | 11/2002 | Boecking | 123/467 |
| 6,486,587 | B2 * | 11/2002 | Klenk et al. | 310/316.03 |
| 6,499,464 | B2 * | 12/2002 | Rueger | 123/446 |
| 6,700,301 | B2 * | 3/2004 | Rueger et al. | 310/316.03 |
| 6,784,596 | B2 * | 8/2004 | Rueger et al. | 310/316.03 |
| 6,953,158 | B2 * | 10/2005 | Liskow | 239/102.2 |
| 2002/0041475 | A1 * | 4/2002 | Rueger et al. | 361/91.1 |
| 2002/0046734 | A1 * | 4/2002 | Rueger | 123/446 |
| 2003/0150429 | A1 * | 8/2003 | Rueger | 123/490 |
| 2003/0168933 | A1 * | 9/2003 | Rueger et al. | 310/316.03 |

(Continued)

FOREIGN PATENT DOCUMENTS

DE 10039418 2/2002

(Continued)

OTHER PUBLICATIONS

European Search Report dated Apr. 15, 2008.

*Primary Examiner*—Mahmoud Gimie
(74) *Attorney, Agent, or Firm*—Thomas N. Twomey

(57) ABSTRACT

A method for controlling a piezoelectric actuator of a fuel injector for controlling the quantity of fuel injected into the cylinders of an internal combustion engine controls the voltage across the injector in accordance with a voltage/charge vs. time profile in which the injector is driven at high current up to a level required to start injection, and then at lower current, resulting in a lower voltage/charge vs. time gradient, until the point where full charge is achieved. This results in a reduced variation in minimum delivery pulse and a reduction in the slope of the gain curve, as compared with conventional arrangements in which the voltage/charge vs. time gradient is constant. Alternatively, the injector may be driven at high current up to the charge level required to switch to hydraulic lift amplification. Any point of current change between these extremes may also be used with good effect. In alternative arrangements, a voltage/charge hold or zero current phase or even a negative current phase may be introduced between the two current phases. The charge across the actuator may be controlled, with the effect of varying voltage, or the voltage may be controlled directly.

23 Claims, 5 Drawing Sheets

U.S. PATENT DOCUMENTS

| | | | | |
|---|---|---|---|---|
| 2005/0224041 | A1 | 10/2005 | Herrmann et al. | |
| 2005/0252494 | A1* | 11/2005 | Rauznitz et al. | 123/498 |
| 2006/0118092 | A1 | 6/2006 | Vorbach | |
| 2006/0231311 | A1 | 10/2006 | Fujii et al. | |
| 2007/0240685 | A1 | 10/2007 | Beilharz et al. | |

FOREIGN PATENT DOCUMENTS

| | | |
|---|---|---|
| DE | 19921456 | 9/2003 |
| EP | 1139448 | 10/2001 |
| WO | 2005/061879 | 8/2000 |

* cited by examiner

PIEZOELECTRIC FUEL INJECTORS

TECHNICAL FIELD

The present invention relates to piezoelectric fuel injectors and, in particular, to control circuits for controlling the voltage across such injectors and to corresponding methods of controlling such injectors.

BACKGROUND TO THE INVENTION

Piezoelectric fuel injectors are used in vehicles to control the amount of fuel injected into the cylinders of an internal combustion engine, such as a diesel engine. The amount of fuel injected depends on the size of the orifice of a nozzle within the injector, and this, in turn, is controlled by a valve needle which moves in relation to a valve seating by an amount which depends on the voltage across a piezoelectric actuator.

An electric current is supplied to the piezoelectric actuator which stores the charge and develops a corresponding voltage across its terminals which is directly proportional to the quantity of charge stored.

Examples of such piezoelectric fuel injectors are described in EP 0995901 A and EP 1174615 A. In such injectors the nozzle needle is opened by the energy supplied to the piezoelectric actuator and the needle lift is a function of the electrical energy supplied. At high fuel pressures, a relatively large force is required to lift the valve needle from its seating, but once the needle is lifted by a certain amount, fuel pressure builds up under the valve needle and the force required to lift the needle any further diminishes rapidly, so that the needle is caused to lift extremely quickly. While fast needle opening is desirable for low-smoke emission, excessive speed causes difficulty in control of the fuelling delivered by the injector. The injector of EP 1174615 A partly addresses this problem by providing a two-stage motion amplifier, but at high pressure there are still some fuelling situations where accurate control is critical but not necessarily possible.

FIG. 1(*a*) shows a series of typical voltage (or charge) vs. time waveforms (voltage/charge-time waveforms) for an injector of the type described in EP 1174615. Voltage/charge-time waveform 1 illustrates the minimum voltage required to cause an injection and voltage/charge-time waveform 2 illustrates the waveform required to lift the injector needle and hold it at full lift for a period of time. FIG. 1(*a*) also shows representative negative-gradient slopes (dashed lines) illustrating cases where the fuel injection is terminated prior to the maximum voltage/charge level. The slope 3*a* of the voltage/charge-time waveform 1, 2 is proportional to the current flow to or from the actuator. Note that the injectors of EP 0995901 A and EP 1174615 A are of the "de-energize to inject" type, i.e. a voltage is reduced to start an injection, but the voltage/charge-time waveforms have been inverted here as an aid to understanding.

FIG. 1(*b*) shows corresponding fuel quantity delivered vs. time graphs (fuel delivery curves) for an aged injector (curve 9) and for an injector in a new condition (curve 4). As the actuator ages its piezoelectric activity diminishes and, as the nozzle seat wears, its effective area changes (increasing or decreasing, depending on the design). Both of these effects can cause a shift in the voltage/charge level required to initiate an injection from an initial level 5 to an "aged" level 6. These effects are seen by comparing fuel delivery curves 4 and 9. The age/wear effects result in a change of the minimum delivery pulse time from an initial value 7 to an aged value 8, and a shifting of the gain curve from the initial fuel delivery curve 4 to the aged fuel delivery curve 9. Where the slope of the fuel delivery curve is low, the fuelling variation 10 is relatively small, but where the slope is high the fuelling variation 11 is much larger. When the injector is run in an engine, an additional effect is that coking/lacquering of the nozzle causes the flow to reduce, making the needle lift faster so that the steep part of the fuel delivery curve gets steeper, but the slope when fully lifted is lower, resulting in a new fuel delivery curve 12. Combining the aforementioned effects results in a fuel delivery curve 13, which is sometimes higher, e.g. at region 14, and sometimes lower, e.g. at region 15, than the original fuel delivery curve 4. This combined effect is extremely difficult for an engine control unit (ECU) to correct for as there is no easy way of knowing how much of each contributing effect has occurred.

The fuel delivery curve 4 for the new injector in FIG. 1 shows three distinct sections of different slope. From the charge level 5 required to initiate injection to the charge level 16 required to switch into hydraulic lift amplification, the slope of the fuel delivery curve is low. This is advantageous for accurate control of pilot injections. From the voltage/charge level 16 required to start hydraulic amplification to the voltage/charge level 17 at full needle lift, there is a steep slope section. This is because of the fast needle lift during this period caused by a combination of the hydraulic amplification and the pressure building under the nozzle seat helping to open the needle. Once full needle lift is reached the slope of the fuel delivery curve reduces again.

FIG. 2 illustrates voltage/charge drive waveforms and corresponding fuel quantity delivered vs. time graphs (fuel delivery curves) which show the effect of increasing the current supplied to the piezoelectric actuator. By increasing the current, the slope 3*b* of the voltage/charge-time waveform increases. This means that the change 18 in minimum delivery pulse required to start an injection, caused by the change in voltage/charge from level 5 to level 6, is reduced. This in turn reduces the variation 19 in pilot injection quantity. Because the higher current level causes the needle to open faster, however, the slope of the second region of the fuel delivery curve is increased, resulting in there still being a large variation 20 in the fuel quantity delivered in this region. As with FIG. 1(*a*), negative-gradient slopes are shown (dashed lines) which illustrate termination of the fuel injection prior to the maximum voltage/charge level.

The present invention seeks to provide arrangements for driving the injector where the fuelling variation can be reduced over the full range of fuel deliveries.

SUMMARY OF THE INVENTION

Thus, in accordance with a first aspect of the present invention there is provided a method for controlling the voltage across a piezoelectric fuel injector in accordance with a voltage or charge vs. time waveform which defines: (a) a first gradient during a first portion of a fuel injection cycle which extends from a time at which a nozzle of the injector is fully closed to a time at which the nozzle is partially open; and (b) a second gradient during a second portion of the injection cycle which extends from a time at which the nozzle is partially open to a time at which the nozzle is fully open; wherein the magnitude of the first gradient is greater than the magnitude of the second gradient and wherein the first portion of the injection cycle terminates at a predetermined voltage point.

The injector is typically of the type described in EP 1174615. The injector has a piezoelectric actuator which is arranged to drive a valve of the injector. An amplifier is located between the actuator and the valve which provides a variable amplification of movement throughout the stroke of the actuator i.e. between a position in which the valve is seated and injection is terminated to a position in which the valve is at full lift and injection is occurring. Initially, the actuator is mechanically coupled to the valve to give a first amplification of movement between the actuator and the valve. Part-way through the stroke, the actuator becomes mechanically decoupled from the valve so that further movement of the valve is governed by hydraulic amplification.

The second portion of the injection cycle preferably commences at the same time that the first portion terminates.

The voltage or charge vs. time waveform may alternatively, however, further define a third gradient during an intermediate portion of the injection cycle after the first portion and before the second portion. In this case, the third gradient may be substantially zero, or alternatively may be of a sign which is opposite to that of the first and second gradients.

The second portion of the cycle preferably terminates at the point where the voltage across the injector is at a maximum value.

The method preferably includes controlling the level of current supplied to the piezoelectric fuel injector, thereby to control the voltage across the piezoelectric fuel injector. Alternatively, the voltage across the injector may be controlled directly.

Conveniently, in an embodiment of the invention, the predetermined voltage point is the point where the voltage across the injector is sufficient to start fuel injection.

Conveniently, in another embodiment of the invention, the predetermined voltage point is the point where the voltage across the injector is the maximum level required to initiate an injection in an aged injector.

Conveniently, in a yet another embodiment of the invention, the predetermined voltage point is the point where the voltage across the injector is a value which varies with the age of the injector.

In the yet another embodiment of the invention, the method may include determining the point at which the first portion of the injection cycle terminates using a known ageing characteristic.

Alternatively, the method may include determining the point at which the first portion of the injection cycle terminates using feedback from a sensor within an engine with which the injector is associated.

According to a second aspect of the invention, there is provided a method for controlling the voltage across a piezoelectric fuel injector having a piezoelectric actuator for controlling an injector valve, the method including initially lifting the valve away from a seating to commence injection under mechanical lift amplification between the actuator and the valve and subsequently moving the valve further away from the seating under hydraulic lift amplification between the actuator and the valve, wherein the voltage is controlled in accordance with a voltage or charge vs. time waveform which defines (a) a first gradient during a first portion of a fuel injection cycle which extends from a time at which a nozzle of the injector is fully closed to a time at which the nozzle is partially open; and (b) a second gradient during a second portion of the injection cycle which extends from a time at which the nozzle is partially open to a time at which the nozzle is fully open; wherein the magnitude of the first gradient is greater than the magnitude of the second gradient and wherein the first portion of the injection cycle terminates at a predetermined voltage point.

Conveniently, according to a further embodiment of the second aspect of the invention, the predetermined voltage point is the point where the voltage across the injector is sufficient to cause the injector to switch to hydraulic lift amplification.

Conveniently, according to a still further embodiment of the second aspect of the invention, the predetermined voltage point is the point where the voltage across the injector is greater than that which is sufficient to start fuel injection but less than that required to cause the injector to switch to hydraulic lift amplification.

Any of the preferred or optional features of the first aspect of the invention, may be incorporated alone or in appropriate combination within the second aspect of the invention also. The various embodiments of the invention may also be incorporated with any of the preferred or optional features of the first aspect of the invention.

According to a third aspect of the invention, there is provided a control circuit for performing the method of any of the first, second, third, fourth or fifth aspects of the invention.

The invention extends to a carrier medium for carrying a computer readable code for controlling a processor, computer or control circuit to carry out the method of the first and second aspects of the invention.

BRIEF DESCRIPTION OF THE DRAWINGS

The background to the invention has already been described with reference to:

FIG. 1(*b*) which shows fuel quantity delivered vs. time graphs corresponding to the voltage/charge vs. time waveforms in FIG. 1(*a*), and FIG. 2 which shows a corresponding waveform and graph for a piezoelectric fuel injector where the current through the actuator is increased compared to FIGS. 1(*a*) and 1(*b*).

Figure 3:
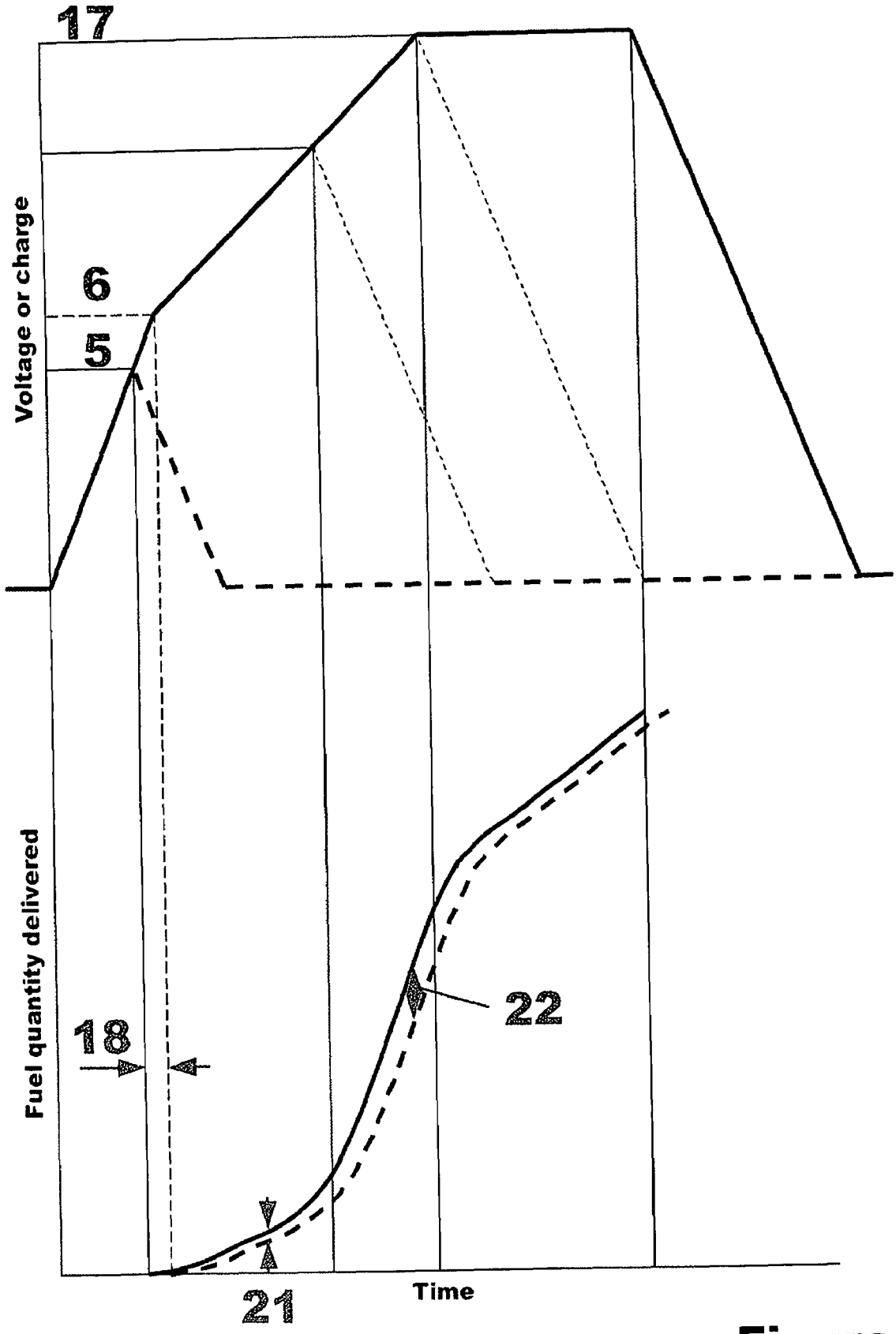
Figure 4:
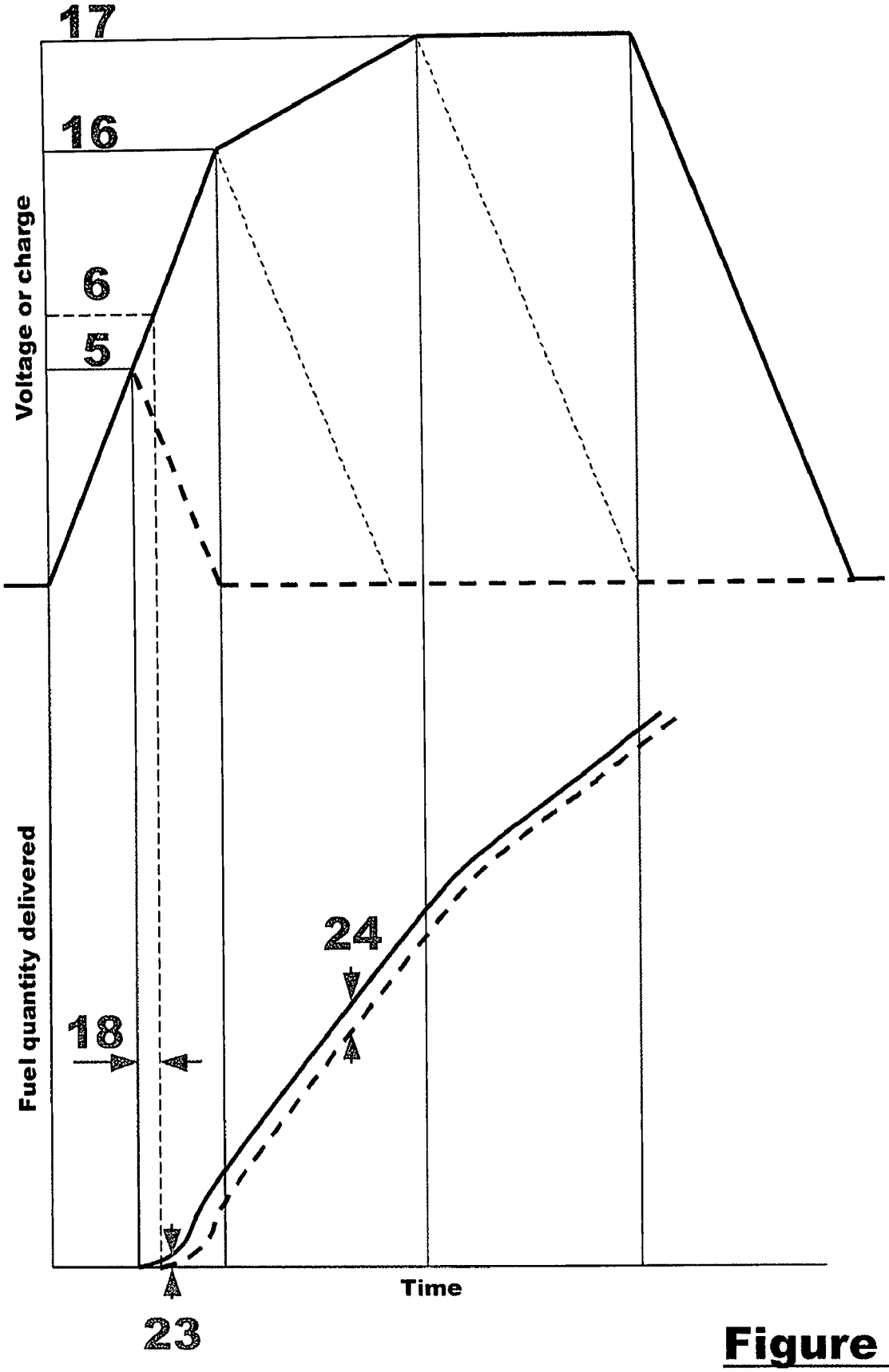
Figure 5:
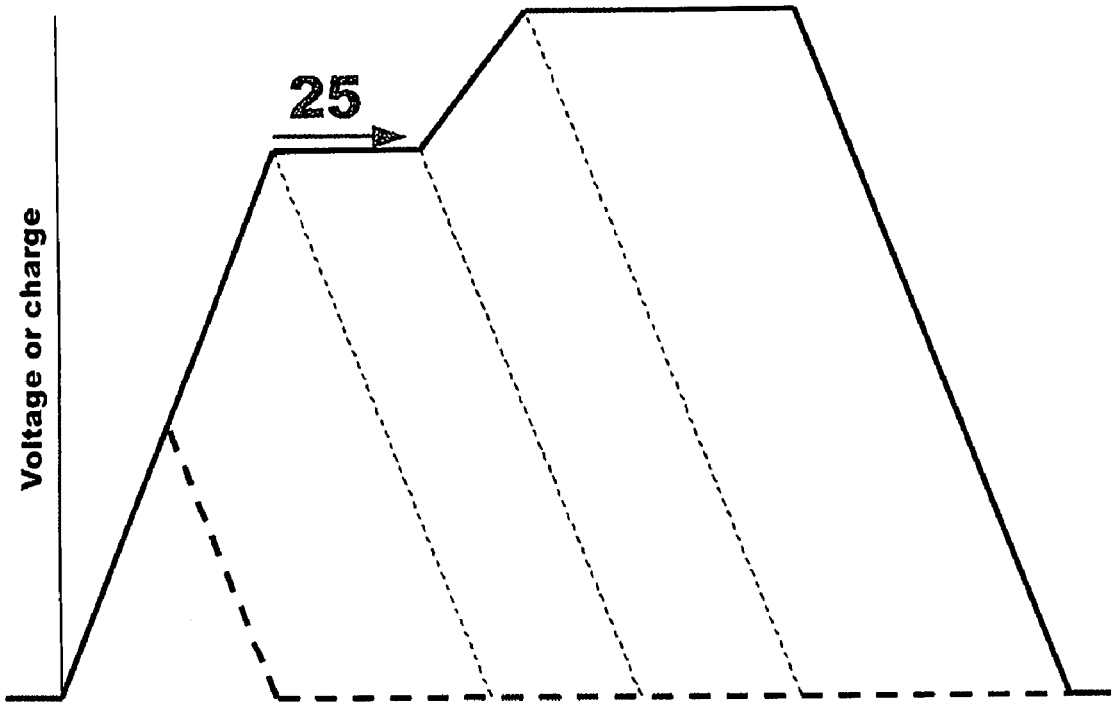
Figure 6:
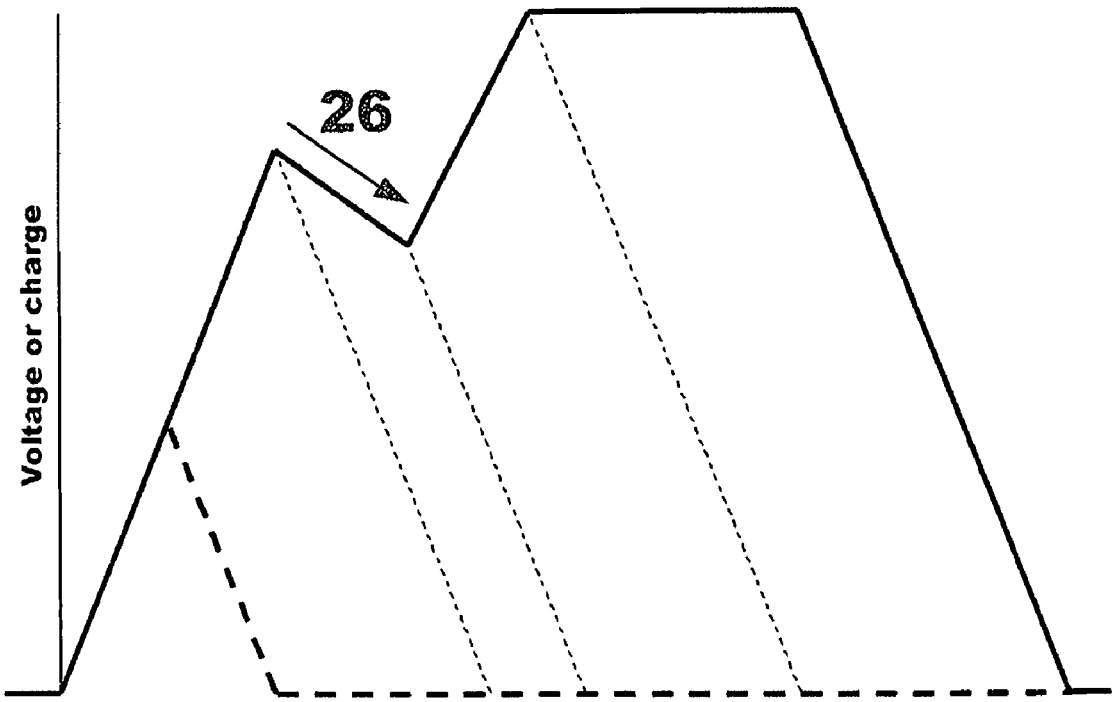

Preferred embodiments of the present invention will now be described with reference to the accompanying drawings, in which:

FIG. 3 shows a corresponding voltage/charge vs. time waveform and fuel delivery vs. time graph for a piezoelectric fuel injector in accordance with a first embodiment of the present invention;

FIG. 4 shows a corresponding voltage/charge vs. time waveform and fuel delivery vs. time graph for a piezoelectric fuel injector in accordance with a second embodiment of the present invention;

FIG. 5 shows a corresponding voltage/charge vs. time waveform and fuel delivery vs. time graph for a piezoelectric fuel injector in accordance with a third embodiment of the present invention; and FIG. 6 shows a corresponding voltage/charge vs. time waveform and fuel delivery vs. time graph for a piezoelectric fuel injector in accordance with a fourth embodiment of the present invention.

DETAILED DESCRIPTION OF THE PREFERRED EMBODIMENTS

FIG. 3 illustrates a voltage/charge vs. time waveform and corresponding fuel quantity delivered vs. time graph in accordance with a first embodiment of the present invention. The voltage/charge vs. time waveform is representative of a waveform applied to a fuel injector of the type described in EP 1174615 A, as described previously, which has a piezoelectric actuator coupled to a valve of the injector via a two-stage motion amplifier. With the waveform of FIG. 3, the piezoelectric fuel injector is driven with a high current up to the charge level 6 required to start an injection, and the current is subsequently reduced to a lower level, resulting in a lower voltage/charge gradient, until the point 17 where full charge is achieved. As can be seen from the fuel quantity delivered vs. time graph in FIG. 3, this results in a reduced variation 18 in the minimum fuel delivery pulse and also reduces the slope of both the first and second regions of the fuel delivery curve. This results in a smaller variation in the fuelling quantity both in a pilot section 21 and a steep section 22 of the fuel delivery curve. The charge level 6 at which the change in current takes place may be chosen to be at the maximum level required to initiate an injection in an aged injector. Alternatively, the level of the charge at which the current changes may be adapted during the life of the injector from an initial level 5 to an aged level 6. This may be achieved either using a known aging characteristic, or using feedback from a sensor associated with the engine, such as an accelerometer, cylinder pressure sensor or exhaust emissions sensor.

FIG. 4 illustrates a voltage/charge vs. time waveform and corresponding fuel quantity delivered vs. time graph in accordance with a second embodiment of the present invention. In this case, the injector is driven with a high current up to the charge level 16 required to switch to hydraulic lift amplification and with a lower current up to the full charge level 17.

This results in a reduction of the minimum delivery pulse variability 18, shortens the time spent in the mechanical lift mode and reduces the slope of the fuel delivery curve in a steep section 24. This strategy also gives low variability in the pilot section 23 and the steep section 24 of the fuel delivery curve, but gives a smaller range of deliveries in the mechanical lift mode. As before, the charge level at which the current change takes place may be adapted throughout the life of the injector.

Figure 1:
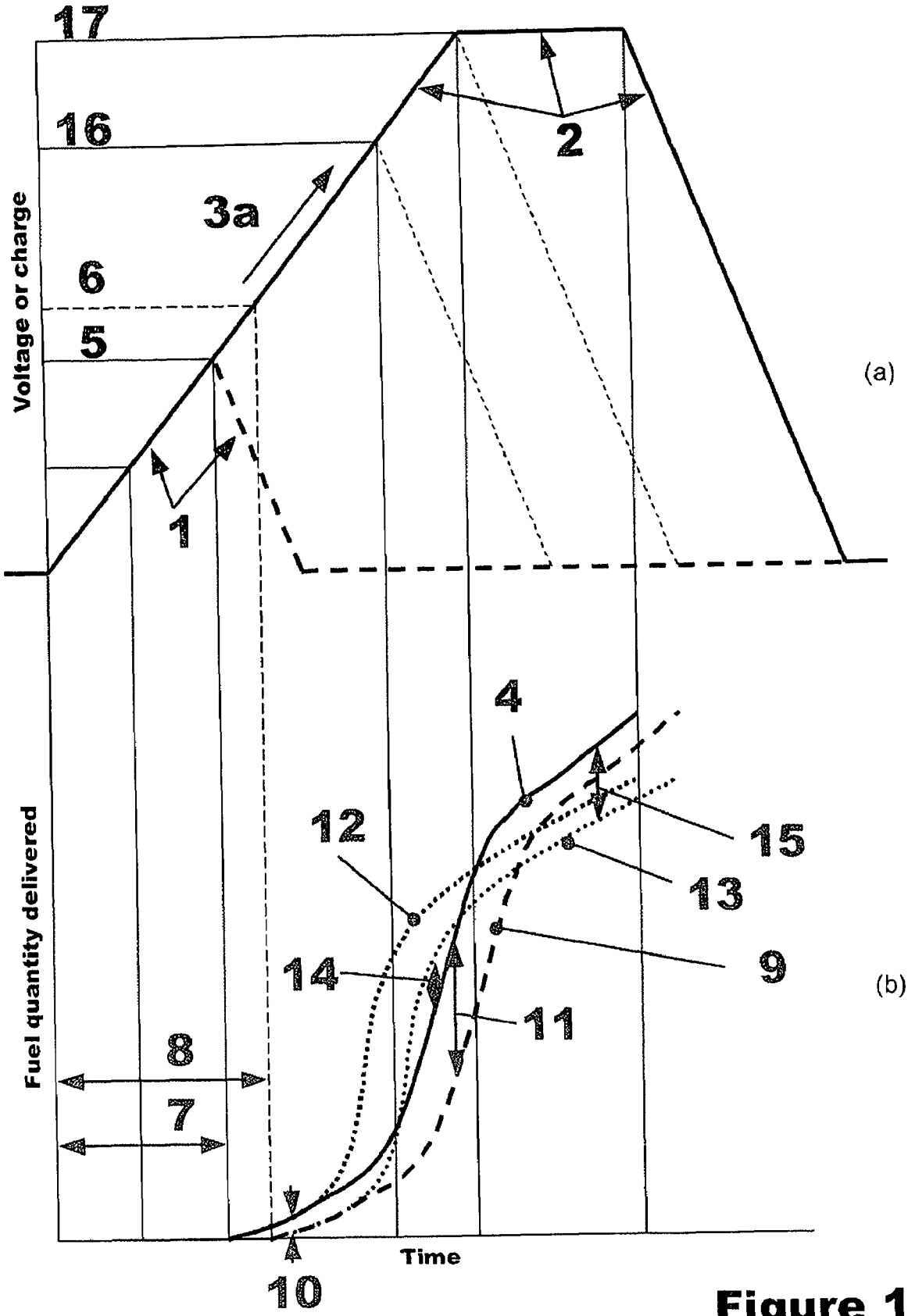
FIG. 1(*a*) which shows a voltage/charge vs. time waveform for a known piezoelectric fuel injector.
Figure 2:
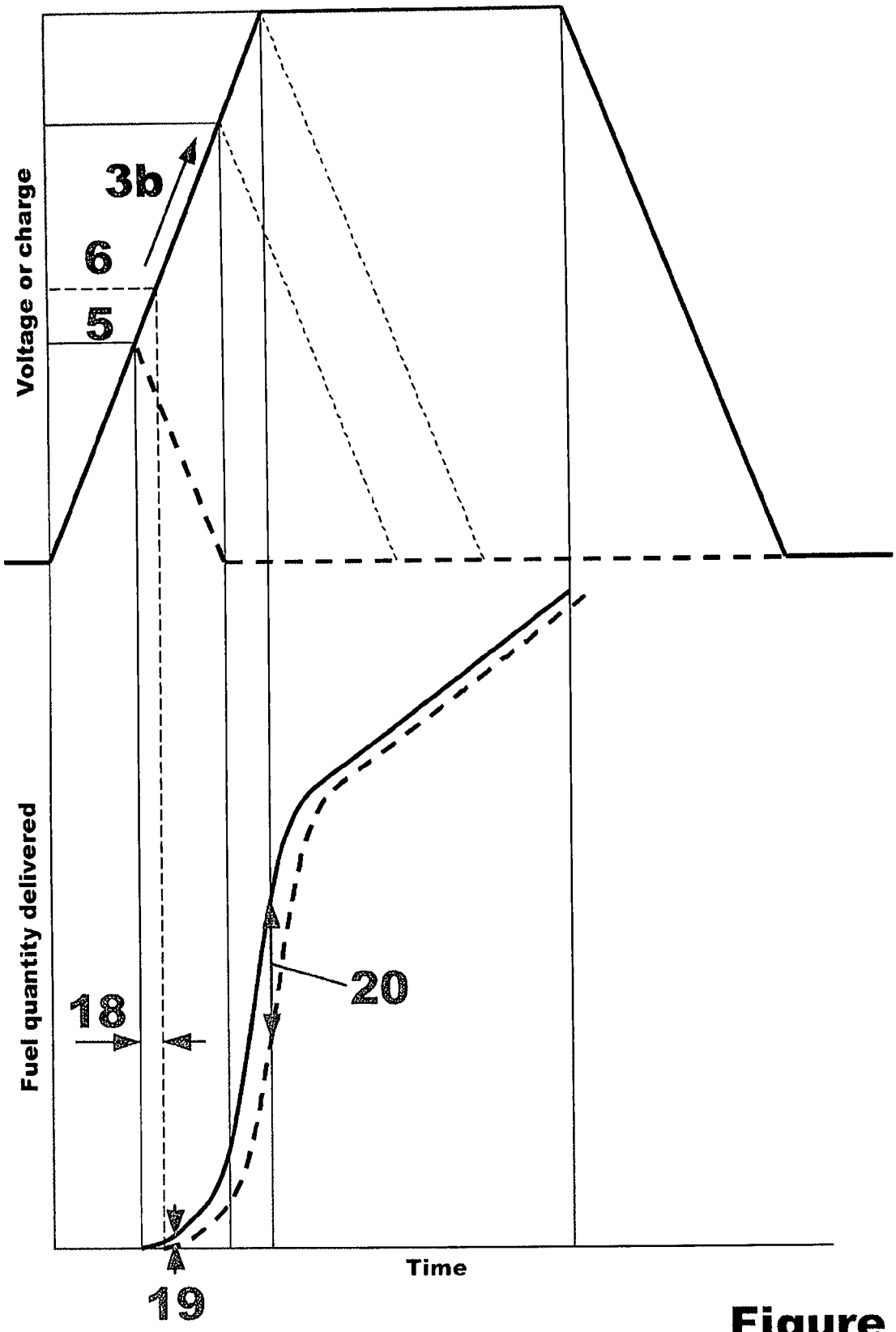

Any point of current change between the extremes indicted by FIGS. 3 and 4 may also be used with good effect. The point of current change may also fall outside of the range indicated, but with reduced benefits. Whilst the description has been mainly in relation the injector of EP 1174615 A, it will be appreciated that the strategy may be applied to the injector of EP 0995901 A or any other direct acting injector, with the difference that there is no mechanical lift mode, so the first low slope section of the fuel delivery curve will be absent, or less pronounced. Whilst two distinct current levels have been indicated, the current level may also be switched in a continuous manner, or in several discrete steps, as long as there is a high level at or near the start of injection followed by a lower level at some point in the needle lift. Also whilst the description has been mainly aimed at reducing the variability created by drift of the minimum delivery pulse, it will be appreciated that the reduction of fuel delivery curve slopes also reduces the sensitivity to variations created by differences in the nozzle flow rate as shown on FIG. 1(*b*).

FIGS. 5 and 6 illustrate voltage/charge vs. time waveforms and corresponding fuel quantity delivered vs. time graphs in accordance with third and fourth embodiments of the present invention, respectively, and which represent variations of the embodiments illustrated in both FIGS. 3 and 4. In FIG. 5 a voltage/charge hold or zero current phase 25 is introduced between the other two current phases. In FIG. 6 a negative current phase 26 is introduced between the other two current phases. In both cases these may be used to further reduce the slope of the fuel delivery curve and thus the variability of fuelling.

In each of FIGS. 3 to 6, negative-gradient slopes are shown (dashed lines) which illustrate termination of the fuel injection prior to the maximum voltage/charge level.

This technique may also be used in the driving of a variable-orifice nozzle which opens up different nozzle spray hole areas by operating different valves depending on the needle lift. High current phases followed by low current phases may be used either for the opening of the first stage only, or for the opening of both stages.

It will be appreciated that the method is appropriate for either voltage-control strategies, where the voltage across the actuator is controlled directly in a closed loop strategy, or for charge-control methods, where the charge (current) across the actuator is controlled in an open loop strategy with the effect of varying the voltage across the actuator.

The invention claimed is:

1. A method for controlling the voltage across a direct acting piezoelectric fuel injector in accordance with a voltage or charge vs. time waveform that defines:

(a) a first gradient during a first portion of a fuel injection cycle that extends from a time at which a nozzle of the injector is fully closed to a time at which the nozzle is partially open; and (b) a second gradient during a second portion of the fuel injection cycle that extends from a time at which the nozzle is partially open to a time at which the nozzle is fully open;

wherein:

(i) the magnitude of the first gradient is greater than the magnitude of the second gradient;

(ii) the first portion of the injection cycle terminates at a predetermined voltage point; and the predetermined voltage point is the point at which the voltage across the injector is less than or equal to that required to cause the injector to switch to a hydraulic lift amplification mode.

2. A method as claimed in claim 1, wherein the second portion of the injection cycle commences at the same time that the first portion terminates.

3. A method as claimed in claim 1, wherein the voltage or charge vs. time waveform further defines a third gradient during an intermediate portion of the injection cycle after the first portion and before the second portion.

4. A method as claimed in claim 3, wherein the third gradient is substantially zero.

5. A method as claimed in claim 3, wherein the sign of the third gradient is opposite to that of the first and second gradients.

6. A method as claimed in claim 1, wherein the second portion of the injection cycle terminates at the point where the voltage across the injector is at a maximum value.

7. A method as claimed in claim 1, including controlling the level of current or charge supplied to the piezoelectric fuel injector, thereby to control the voltage across the piezoelectric fuel injector.

8. A method as claimed in claim 1, wherein the predetermined voltage point is the point where the voltage across the injector is sufficient to start fuel injection.

9. A method as claimed in claim 1, wherein the predetermined voltage point is the point where the voltage across the injector is the maximum level required to initiate an injection in an aged injector.

10. A method as claimed in claim 1, wherein the predetermined voltage point is the point where the voltage across the injector is a value that varies with the age of the injector.

11. A method as claimed in claim 10, including determining the point at which the first portion of the injection cycle terminates using a known ageing characteristic.

12. A method as claimed in claim 10, including determining the point at which the first portion of the injection cycle terminates using feedback from a sensor within an engine with which the injector is associated.

13. A method for controlling the voltage across a direct acting piezoelectric fuel injector having a piezoelectric actuator for controlling an injector valve, the method comprising;

initially lifting the valve away from a seating to commence injection under mechanical lift amplification between the actuator and the valve and subsequently moving the valve further away from the seating under hydraulic lift amplification between the actuator and the valve, wherein the voltage is controlled in accordance with a voltage or charge vs. time waveform that defines:

(a) a first gradient during a first portion of a fuel injection cycle that extends from a time at which a nozzle of the injector is fully closed to a time at which the nozzle is partially open; and (b) a second gradient during a second portion of the injection cycle that extends from a time at which the nozzle is partially open to a time at which the nozzle is fully open;

wherein:

the magnitude of the first gradient is greater than the magnitude of the second gradient; the first portion of the injection cycle terminates at a predetermined voltage point; and the predetermined voltage point is the point at which the voltage across the injector is less tan or equal to that required to cause the injector to switch to a hydraulic lift amplification mode.

14. A method as claimed in claim 13, wherein the second portion of the injection cycle commences at the same time that the first portion terminates.

15. A method as claimed in claim 13, wherein the voltage or charge vs. time waveform further defines a third gradient during an intermediate portion of the injection cycle after the first portion and before the second portion.

16. A method as claimed in claim 15, wherein the third gradient is substantially zero.

17. A method as claimed in claim 15, wherein the sign of the third gradient is opposite to that of the first and second gradients.

18. A method as claimed in claim 13, wherein the second portion of the injection cycle terminates at the point where the voltage across the injector is at a maximum value.

19. A method as claimed in claim 13, including controlling the level of current or charge supplied to the piezoelectric fuel injector, thereby to control the voltage across the piezoelectric fuel injector.

20. A method as claimed in claim 13, wherein the predetermined voltage point is the point where the voltage across the injector is sufficient to cause the injector to switch to hydraulic lift amplification.

21. A method as claimed in claim 13, wherein the predetermined voltage point is the point where the voltage across the injector is greater than that which is sufficient to start fuel injection but less than that required to cause the injector to switch to hydraulic lift amplification.

22. A control circuit for implementing a method in accordance with claim 1 or 13.

23. A carrier medium for carrying a computer readable code for controlling a processor, computer or control circuit to carry out the method of claim 1 or 13.

* * * * *